United States Patent [19]

Emsellem

[11] Patent Number: 5,062,436

[45] Date of Patent: Nov. 5, 1991

[54] HAIR BARRETTE INCORPORATING AN ORNAMENTAL PIN

[76] Inventor: David Emsellem, 10300 Glen Rd., Potomac, Md. 20854

[21] Appl. No.: 417,044

[22] Filed: Oct. 4, 1989

[51] Int. Cl.[5] ..... A45D 8/24

[52] U.S. Cl. ..... 132/279; 132/275; 132/278

[58] Field of Search ..... 132/273, 275, 276, 277, 132/278, 279; 63/20

[56] References Cited

U.S. PATENT DOCUMENTS

| | | | |
|---|---|---|---|
| 921,702 | 5/1909 | Howe | 132/279 |
| 1,085,552 | 1/1914 | DiNaccio | 132/279 |
| 1,110,446 | 9/1914 | Lange | 132/275 |
| 1,234,308 | 7/1917 | Droll | 132/275 |
| 2,144,375 | 1/1939 | Huppert | 63/20 |
| 2,767,721 | 10/1956 | Cockley | 132/279 |
| 2,921,589 | 1/1960 | Blomme | 132/279 |
| 3,192,932 | 7/1965 | Hart | 132/275 |
| 3,805,813 | 4/1974 | Laughton | 132/279 |
| 3,817,260 | 6/1974 | Kleine | 132/276 |
| 3,881,501 | 5/1975 | Kleine | 132/279 |

FOREIGN PATENT DOCUMENTS

| | | | |
|---|---|---|---|
| 862047 | 1/1953 | Fed. Rep. of Germany | 132/279 |
| 2455444 | 1/1981 | France | 132/279 |

OTHER PUBLICATIONS

Drawing of "Standard Barrette", available on U.S. market.

*Primary Examiner*—John J. Wilson
*Assistant Examiner*—Frank A. LaViola
*Attorney, Agent, or Firm*—Beveridge, DeGrandi & Weilacher

[57] ABSTRACT

A hair barrette designed to receive in releasably locking fashion an ornamental pin normally only attachable to a person's clothes. The hair barrette features a main body with an aperture formed at one or both ends with each aperture being dimensioned to receive a pivot pin clasp or pivot post of an ornamental pin. The ornamental pin is affixed to the hair barrette by inserting the pivot pin and pivot post of the ornamental pin through an aperture and inserting the pivot pin clasp of the ornamental pin through either another aperture or a slot formed in the main body. The pivot pin is then pivoted into attachment with the pivot pin clasp. Between the two apertures is positioned a bridge member which bends the pivot pin slightly outward so as to enhance the holding power of the pivot pin clasp. The hair barrette further includes a clamping member in the form of a thin strip of material or a U-shaped member pivotably attached to an end of the main body and an attachment member for releasably locking the clamping member. In use, a bundle of hair is clamped between the clamping member and main body such that both the hair barrette and attached ornamental pin are held in place in the user's hair.

29 Claims, 2 Drawing Sheets

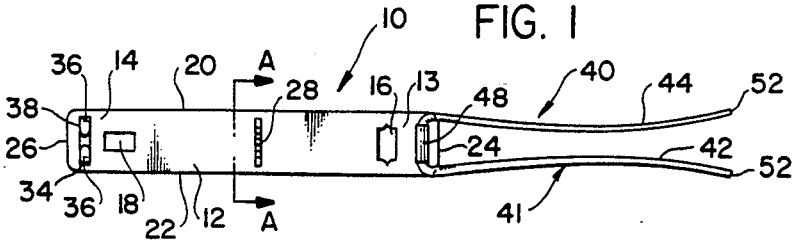
FIG. 1
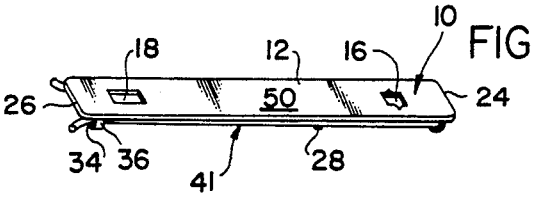
FIG. 2
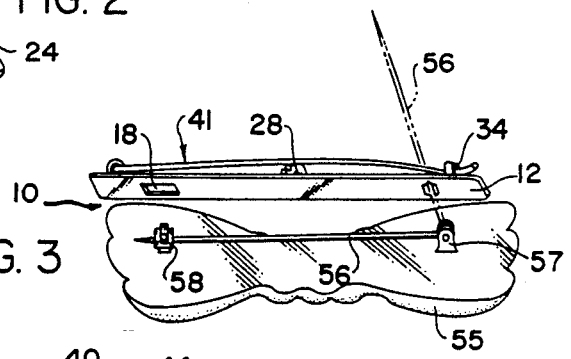
FIG. 3
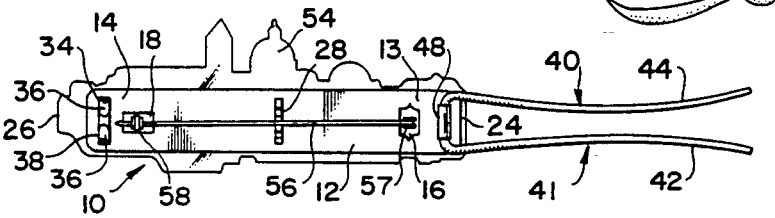
FIG. 4
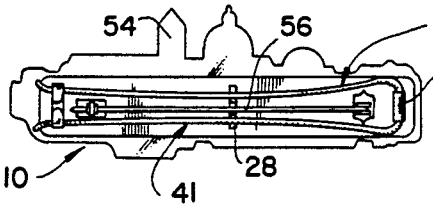
FIG. 5
FIG. 6
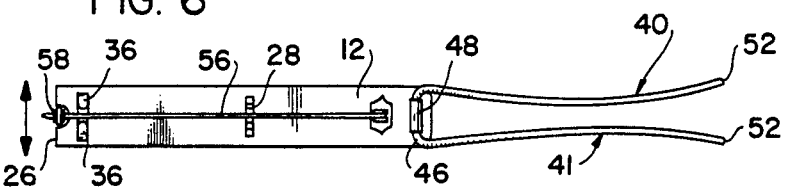
FIG. 6A
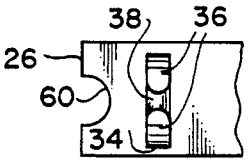

FIG. 7
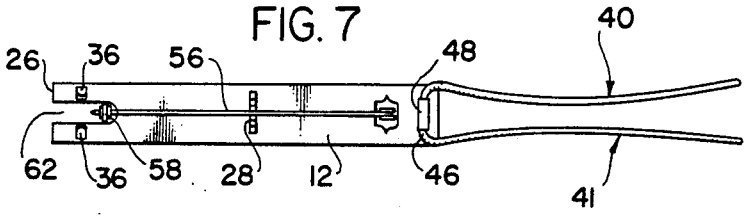
FIG. 7A
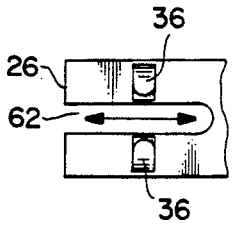
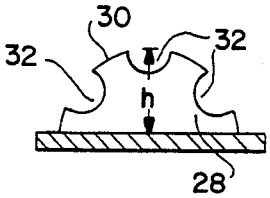
FIG. 8
FIG. 9
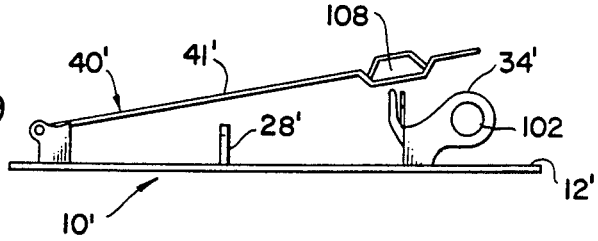
FIG. 10A
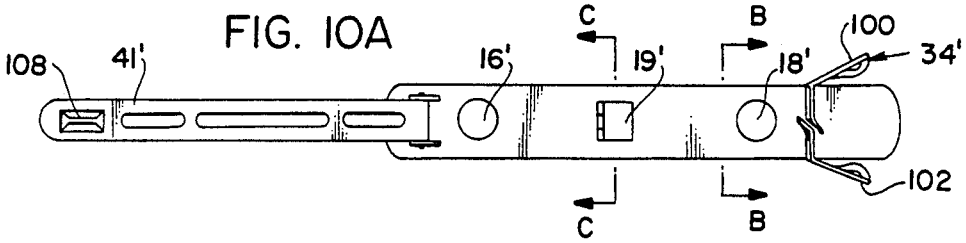
FIG. 10B
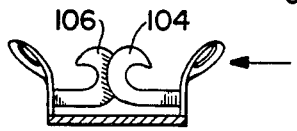
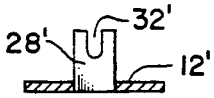
FIG. 10C
FIG. 11
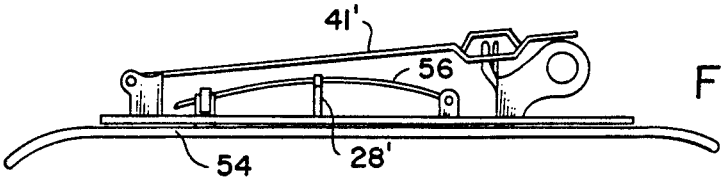

HAIR BARRETTE INCORPORATING AN ORNAMENTAL PIN

BACKGROUND OF THE INVENTION

1. Field of the Invention

This invention relates to a barrette for holding a person's hair in place. More particularly, the present invention relates to a device for clasping hair while simultaneously securing an ornamental pin in place.

2. Description of the Related Art

Hair barrettes or hair clasping devices have been utilized for a long period of time as exemplified by U.S. Pat. No. 921,702 to Howe. As shown by Howe, barrettes typically include a curved metal strip having a wire clasp or pin that closes about the user's hair to maintain the hair in place.

It is also a common custom for people to adorn themselves with ornamental structures such as ribbons or brooches In U.S. Pat. No. 887,149 to Tarnow, there is disclosed a fastening device for securing bows in a person's hair. In U.S. Pat. No. 1,089,829 there is disclosed a brooch which is attached to a person's clothing.

The prior art, however, fails to present a hair barrette that is designed to secure and maintain in place an ornamental pin or brooch normally only attachable to a person's clothing.

SUMMARY OF THE INVENTION

The present invention introduces a hair barrette which is designed to secure and maintain in place an ornamental pin or brooch normally only attachable to a user's clothing. Accordingly, the present invention greatly enhances the versatility of an ornamental pin in that the ornamental pin can be worn not only on a person's clothes but also in the person's hair.

In one embodiment of the present invention, a hair barrette includes an elongated main body preferably formed of a planar strip of material. The planar strip of material has an aperture formed at each of its ends. A first of the two apertures is shaped and dimensioned so as to receive therethrough either the pivot pin and pivot post of an ornamental pin or the pivot pin clasp of the ornamental pin. The second aperture is preferably elongated such as by utilizing an elliptical shaped aperture or a rectangular shaped aperture. The second aperture is also shaped and dimensioned so as to receive therethrough either the clasping portion or the pivot pin and pivot post of the ornamental pin. The elongated second aperture enables the use of the present invention with a wide assortment of ornamental pins as explained more fully below.

The hair barrette of the present invention further includes a clamping member which is adapted to assume a first position clamped about the user's hair and a second detached or open position. To place and releasably maintain the clamping member in the first position, attachment means is provided.

In one embodiment of the present invention the clamping means comprises a U-shaped spring rod having its base pivotably attached to one end of the main body. The U-shaped member includes a pair of legs which extend away from the base towards the opposite end of the main body. At said opposite end is positioned the attachment member which preferably comprises a pair of inwardly extending hooks that releasably engage the outwardly biased arms of the U-shaped member.

Between the two apertures is positioned a bridge member which extends out away from one of the surfaces of the planar main body. The bridge member preferably includes an outer curved edge which has one or more recesses formed therein. The recesses are semicircular and just slightly larger in radius than the radius of the pivot pin forming part of the ornamental pin. In this way, the pivot pin can be transversely locked in place once inserted within the recess.

In utilizing the present invention, the pivot pin of the ornamental pin or brooch is inserted through one of the apertures such that the pivot pin extends out away from the same surface to which the bridge is secured. The aperture through which the pivot pin extends is also dimensioned to receive therethrough the pivot post of the ornamental pin. The clasp or attachment device formed on the ornamental pin is then inserted through the remaining aperture and the pivot pin is pivoted into engagement with the clasp extending through said remaining aperture. Accordingly, the ornamental pin is releasably secured to the hair barrette once the pivot pin is lockingly received by the clasp.

The barrette can then be secured to a person's hair by clamping a bundle of hairs between the clamping member and the underlying surface of the main body. When using the U-shaped clamping member such clamping is achieved by pinching the two elongated arms and inserting them between the inwardly extending hooks.

In fastening the ornamental pin to the present invention, the bridge member causes the pivot pin to bow slightly outward while the recess in the bridge prevents any lateral shifting of the pin with respect to the barrette. In addition, the bridge member enhances the holding power of the barrette with respect to the hair being clamped.

In an alternate embodiment of the invention, the main body includes a recess or slot which originates at the second end of the main body and extends inwardly towards the first end. Hence, the recess or slot is relied upon instead of the elliptical or rectangular aperture in the first embodiment. The use of an extended slot enables the present invention to be used with a wide variety of ornamental pins.

BRIEF DESCRIPTION OF THE DRAWINGS

The present invention will be more fully understood from the detailed description given hereinbelow and the accompanying drawings which are given by way of illustration only, and thus are not limitative of the present invention, and wherein:

FIG. 1 shows a bottom view of a first embodiment of the invention with the clamping member in a detached state.

FIG. 2 shows, in perspective, the top surface of the embodiment shown in FIG. 1 with the clamping member in an attached state.

FIG. 3 shows the manner in which an ornamental pin is fastened to the present invention.

FIG. 4 shows a bottom view of the present invention with the ornamental pin affixed thereto and the clamping member in a detached state.

FIG. 5 shows a bottom view of the present invention with the ornamental pin affixed thereto and the clamping member in an attached state.

FIG. 6 shows the bottom view of a second embodiment of the invention with an ornamental pin affixed thereto and the clamping member in a detached state.

FIG. 6A shows a cut-away view of the main body shown in FIG. 6.

FIG. 7 shows the bottom view of a third embodiment of the invention with an ornamental pin affixed thereto and the clamping member in a detached state.

FIG. 7A shows a cut-away view of the main body shown in FIG. 7.

FIG. 8 shows a cross-sectional view of the main body along line A—A in FIG. 1

FIG. 9 shows an elevational side view of a fourth embodiment of the present invention.

FIG. 10A shows a plan view of the embodiment shown in FIG. 9.

FIG. 10B shows a cross-sectional view taken along lines B—B in FIG. 10A.

FIG. 10C shows a cross-sectional view taken along lines C—C in FIG. 10A.

FIG. 11 shows an elevational side view of the embodiment shown in FIG. 9 together with an ornamental pin attached thereto.

DETAILED DESCRIPTION OF THE PREFERRED EMBODIMENT

FIG. 1 shows a bottom view of the present invention with the invention comprising hair barrette 10 having main body 12. Main body 12 is preferably formed of a thin, elongated strip of material. Suitable materials for forming main body 12 include materials such as plastic material or metallic material. Main body 12 includes first end 13 and second end 14 as well as first aperture 16 and second aperture 18. Apertures 16 and 18 are positioned about midway between sides 20 and 22 of main body 12. Aperture 16 is also positioned at first end 13 of main body 12 just inwardly of end edge 24. Aperture 18 is formed at second end 14 of main body 12 just inwardly of end edge 26.

Between aperture 16 and aperture 18 is positioned bridge member 28. Bridge member 28 is preferably positioned midway between first aperture 16 and second aperture 18 and, as more fully shown in FIG. 8, bridge member 28 extends transversely to the longitudinal axis (not shown) extending between the center point of apertures 16 and 18 and between sides 20 and 22. In addition, bridge member 28 includes a curved outer edge 30 with the curve preferably being semicircular in shape. Bridge member 28 further features one or more recesses 32 formed inwardly of outer edge 30.

FIG. 1 further shows attachment means 34 positioned between end edge 26 and aperture 18. One form of attachment means found suitable is an attachment member which includes a pair of inwardly extending hooks 36 originating from back support 38.

The form of clamping member 40 found suitable and usable with the above-described attachment member 34 features a U-shaped spring rod 41 having a first elongated arm 42, a second elongated arm 44 and a common base 46 pivotably received within pivot sleeve 48. Sleeve 48 is securely attached to end 13 of main body 12 between end edge 24 and aperture 16.

FIG. 2 shows a top perspective view of the embodiment shown in FIG. 1 wherein apertures 16 and 18 are shown extending through upper surface 50 of main body 12. As shown in FIG. 2 and in other figures such as the planar view shown in FIG. 7A, the apertures extend through the thin, planar strip of material forming main body 12 such that each aperture defines an equal area on the upper and lower surface of main body 12. FIG. 2 also illustrates clamping member 40 in an attached state with respect to attachment member 34. To place clamping member 40 in an attached state diverging ends 52 (FIG. 1) of elongated arms 42, 44 are pinched towards each other and released once inserted between inwardly extending hooks 36. FIG. 2 also illustrates the preferred shape of apertures 16 and 18. Aperture 16 is dimensioned so as to receive either the pivot post or clasp of an ornamental pin and is made of an extended longitudinal length such that a variety of different dimensioned ornamental pins can be utilized with the present invention. A rectangular shape is shown in FIG. 2 for aperture 18 although other shapes such as an elliptical shape could be utilized. An advantage, brought about by broadening the length of either aperture 16 or 18, is found in the fact that such broadening of the apertures allows for the insertion of pivot pin 56 into barrette 10 from either direction (e.g., right to left or left to right). This versatility enables a user to wear ornamental pin 54 on either the left or right side of the head. The significance of this versatility becomes even more important when ornamental pin 54 has a specific orientation.

FIG. 3 shows the manner in which ornamental pin 54 with backing member 55 is affixed to hair barrette 10. As shown, pivot pin 56 is released from pivot pin clasp 58 and pivoted upwardly away from ornamental pin 54 as shown by the dashed lines. Once pivoted outwardly away from ornamental pin 54, pivot pin 56 and pivot post 57 are inserted through either aperture 16 or 18 but preferably aperture 16. At this point, clamping member 40 is preferably in a detached state. Pivot pin clasp 58 is inserted through the remaining aperture and pivot pin 56 is placed in one of recesses 32 formed in bridge 28. Pivot pin 56 is then inserted back into engagement with pivot pin clasp 58 thus releasably affixing ornamental pin 54 to hair barrette 10. Clamping member 40 can then be placed in an attached state to affix both hair barrette 10 and ornamental pin 54 in the hair of the user.

FIG. 4 shows ornamental pin 54 affixed to hair barrette 10. FIG. 4 also shows clamping member 40 in a detached state away from attachment member 34. When pivot pin 56 is secured to pivot pin clasp 58, a central region of pivot pin 56 is received within one of the recesses 32 formed in bridge member 28. Referring again to FIG. 8, height h of bridge member 28 is preferably about $\frac{1}{8}$ to $\frac{1}{4}$ of an inch such that pivot pin 56 is bowed outwardly when received within one of recesses 32 and clasped within pin clasp 58. The bowing out of pin 56 by bridge member 28 while clasped enhances the securement power of pivot pin clasp 58. Variations in height h can be made depending upon the size of the barrette but a preferred height h is about 8% of the total longitudinal length of main body 12. Also, the degree to which the pivot pin 56 is bowed outwardly can be varied by the depth of the recess formed in the bridge. For example, one of the recesses can have a depth equal to $\frac{1}{4}$ to 2 times the diameter of pivot pin 56 and an adjacent recess can have a depth of $1\frac{1}{4}$ to 2 times the diameter of pivot pin 56. Bridge member 28 also enhances the holding power of hair barrette 10 by compressing to a greater degree any hair positioned between bridge member 28 and elongated arms 42, 44.

FIG. 5 shows the final assembly state that hair barrette 10 would assume in the hair of a user. In this state, clamping member 40 is in an affixed state with respect to attachment member 34 and pivot pin 56 is bowed outwardly by bridge member 28 and securely held by clasp 58 such that ornamental pin 54 is securely attached to hair barrette 10. In addition, FIG. 5 shows, when compared to FIG. 4, that pivot post 57 can extend through either the first aperture 16 or the second aperture 18 in affixing ornamental pin 54 to barrette 10.

FIG. 6 shows an alternate embodiment of the invention wherein, rather than a second aperture, positioning recess 60 is formed along end edge 26 and dimensioned so as to prevent transverse movement of pivot pin clasp 58. This embodiment requires that hair pin 10 be dimensioned for a specific size ornamental pin and therefore is less preferable than the first embodiment. FIG. 6A shows a close-up view of positioning recess 60 for receiving clasp 58.

FIG. 7 shows yet another embodiment wherein, rather than an aperture formed at the second end of main body 12, adjustment slot 62 originates at end edge 26 and extends towards the opposite end of main body 12 for a distance of between 5 to 25% of the total longitudinal length of main body 12. This embodiment provides even greater versatility as adjustment slot 62 enables hair barrette 10 to be used with a wide variety of different sized ornamental pins 54. Because of slot 62, inwardly extending hooks 36 do not have a common backing but are unitary members individually attached to main body 12. FIG. 7A shows in greater detail adjustment slot 62 as well as hooks 36.

FIG. 9 shows an elevational side view of a fourth embodiment of the invention. Like the other embodiments the hair barrette 10' in FIG. 9 includes main body 12', bridge member 28', clamping member 40' and attachment member 34'. As shown in FIG. 10A, clamping member 40' includes a resilient strip of material 41' pivoted at one end of main body 12'. Main body 12' features apertures 16', 18' and 19' with the latter representing the material of main body 12' bent outwardly to form bridge member 28'.

Also shown in FIG. 10A is attachment member 34' which includes ears 100 and 102 which can be compressed inwardly as shown in FIG. 10B to move normally outwardly biased hooks 104 and 106 inwardly so as to disengage hooks 104 and 106 from attachment within recess 108. Recess 108 is formed by bending outwardly in one direction a mid-section segment of strip 41 and bending outwardly in an opposite direction the side edges of flexible strip 41 adjacent the mid-section segment.

FIG. 10C illustrates bridge member 28' as well as recess 32' formed at the upper edge of bridge member 28'.

FIG. 11 shows ornamental pin 54 affixed to barrette 10'. FIG. 11 also shows that clamp post 110, hooks 104 and 106, and strip 41' are dimensioned and arranged such that strip 41' lies just above or, even more preferably, in contact with bridge member 28' or pivot pin 56 (whichever is higher). This arrangement adds to the securement power of the barrette 10' as the user's hair is more securely clamped between strip 41' and bridge 28'.

Although the preferred embodiments of the present invention have been described with reference to the accompanying drawings, many modifications and changes may be effected by those skilled in the art without departing from the scope and spirit of the claimed invention as appended hereinafter.

I claim:

1. A hair barrette, comprising:

an elongated main body having a first end, a second end, a longitudinal axis extending between said first and second ends, two side edges and an upper and bottom surface, said main body including a first aperture formed in said first end, said first aperture being dimensioned and positioned so as to receive therethrough either a pivot post or pivot pin clasp of an ornamental pin such that said hair barrette is adapted to maintain the ornamental pin releasably affixed thereto, and the width of said first aperture extending transverse to the longitudinal axis being greater than the length of said first aperture extending in the direction of the longitudinal axis both on the upper and lower surface of said main body so as to limit longitudinal shifting of either the pivot post or pivot pin clasp of the ornamental pin, said main body further including a second aperture formed in the second end of said main body and spaced from said first aperture so as to receive therethrough either the pivot post or the pivot pin of the ornamental pin;

a clamping member having a first end and second end with said first pivotably attached to one of said ends of said main body, and said clamping member adapted to assume an attached position and a detached position;

attachment means for releasably retaining said clamping member in the attached position; and a bridge member attached to said main body and positioned between said first and second ends, said bridge member extending between the two side edges of said main body in a direction transverse to the longitudinal axis extending through the first and second ends of said main body and said first aperture being positioned between said bridge member and one of the ends of said clamping member.

2. A hair barrette as recited in claim 1, wherein said clamping member includes a flexible strip which is adapted to contact said bridge member when in said attached position.

3. A hair barrette as recited in claim 1, wherein said main body includes a second aperture formed in said second end and dimensioned so as to receive therethrough either the pivot post or pivot pin clasp of the ornamental pin.

4. A hair barrette as recited in claim 1, wherein said main body has a longitudinal length and said main body includes a slot originating at said second end and extending towards said first end for part of the longitudinal length of said main body, and said slot being dimensioned so as to receive therethrough either the pivot post or pivot pin clasp of the ornamental pin.

5. A hair barrette as recited in claim 1, wherein said clamping member includes a U-shaped spring rod with a pair of elongated arms extending from a common base, said common base adapted to pivot within a sleeve secured to one end of said main body and said sleeve positioned between one end of said main body and the aperture closest to that end.

6. A hair barrette as recited in claim 5, wherein said attachment means includes hook members secured to the first side of said main body and at an end opposite that of said sleeve, and said elongated arms each including a diverging section and a straight section wherein each of said diverging sections are adapted for releasable securement within a respective one of said hooks.

7. A hair barrette as recited in claim 6, wherein said straight arm sections are spaced transversely away from one another a distance greater than the transverse length of said bridge member.

8. A hair barrette as recited in claim 1, wherein said bridge member includes at least one recess formed therein for retention of a pivot pin of the ornamental pin when the pivot pin is positioned in said recess.

9. A hair barrette as recited in claim 1, wherein said main body further comprises a second aperture formed in said second end and dimensioned so as to receive therethrough either the pivot post or pivot pin clasp of the ornamental pin.

10. A hair barrette as recited in claim 9, wherein said second aperture is elliptical in shape with the major axis extending parallel with a longitudinal axis extending between the first and second ends of said main body.

11. A hair barrette as recited in claim 1, wherein said attachment means is secured to said main body and said first aperture is positioned between the first end of said clamping member and said attachment means.

12. A hair barrette as recited in claim 1, wherein said clamping member is a strip of flexible material with a raised mid-section segment and adjacent lowered edge sections which all together form a reception chamber, and said attachment member is a pair of hooks with attached compression ears, and said attachment member being adapted for releasable retainment within said reception chamber.

13. A hair barrette, comprising:

an elongated main body having a first end and a second end, said main body having a first aperture formed therein which is adapted to receive therethrough either the pivot post or a pivot pin clasp of an ornamental pin, and said main body having a second aperture formed therein at said second end which is adapted to receive therethrough either a pivot pin clasp or pivot post of the ornamental pin;

a bridge member positioned between said first and second apertures and secured to said main body, said bridge member extending transversely to a longitudinal axis extending through the first and second ends of said main body, and said bridge member having a curved outer edge and at least one recess formed in said outer edge;

a clamping member having a first end pivotably secured at one of said ends of said main body;

attachment means for releasably securing a second end of said clamping member, said attachment means being secured to the other end of said main body and said first aperture is formed between said bridge member and one of the ends of said clamping means and is aligned along an axis which essentially bisects said transversely extending bridge member and said main body having an upper surface and a lower surface with said aperture defining an essentially equal opening in both said upper and lower surface of said main body.

14. A hair barrette as recited in claim 13, wherein said bridge member is secured midway between said first and second apertures.

15. A hair barrette as recited in claim 13, wherein said bridge member extends off of said main body member a distance equal to about 8% of the total length of said elongated main body.

16. A hair barrette as recited in claim 13, wherein said clamping member includes a U-shaped spring rod having a base section and two elongated arms extending from said base section, said clamping member further comprising a sleeve which pivotably receives said base section and is secured to one of said ends of said main body.

17. A hair barrette as recited in claim 16, wherein there exist a space between said elongated arms which is greater than the transverse length of said bridge member.

18. A hair barrette as recited in claim 16, wherein said attachment means includes a pair of hooks secured to the second end of said main body, and said hooks extending inwardly towards one another and spaced so as to lockingly receive a respective one of said elongated arms.

19. A hair barrette as recited in claim 13, wherein said second aperture is elliptical in shape with the major axis extending parallel with the longitudinal axis extending between the first and second ends of said main body.

20. A hair barrette as recited in claim 13, wherein said second aperture is rectangular in shape with its longer sides extending parallel with the longitudinal axis extending between the first and second ends of said main body.

21. A hair barrette as recited in claim 13, wherein said attachment means is secured to said main body and said first aperture is positioned between said clamping member and said bridge member.

22. A hair barrette as recited in claim 13, wherein said clamping member includes a flexible strip which is adapted to contact said bridge member when in said attached position.

23. A hair barrette and ornamental pin assembly, comprising:

an ornamental pin having a backing member, a pivot post supported by said backing member, a pivot pin pivotably attached to said pivot post, and a pivot pin claps for releasably retaining said pivot pin, said pivot pin clasp being spaced from said pivot post and supported by said backing member;

a hair barrette having an elongated main body with a first end and a second end, said main body including an aperture formed in said first end which is dimensioned and positioned so as to receive therethrough said pivot post or said pivot pin clasp of said ornamental pin, and said ornamental pin being releasably attached to said hair barrette such that said main body is positioned between said pivot pin and said backing member of said ornamental pin, said hair barrette further comprising a clamping member having a first end pivotably attached to one of said ends of said main body and attachment means for releasably retaining the opposite end of said clamping member.

24. An assembly as recited in claim 23 wherein said pivot pin is releasably retained between said clamping means and said main body when said ornamental pin is releasably attached to said hair barrette and said clamping member is releasably retained by said attachment means.

25. An assembly as recited in claim 23 wherein said main body includes a second aperture formed in said second end, the second aperture being dimensioned so as to receive therethrough either said pivot post or said pivot pin clasp, and the second aperture being spaced from the first aperture a distance essentially equal to the distance said pivot post is spaced from said pivot pin clasp.

26. An assembly as recited in claim 25 further comprising a bridge member secured to said main body and positioned between the first and second apertures, said bridge member extending transversely to a longitudinal axis extending between the first and second ends of said hair barrette.

27. An assembly as recited in claim 26 wherein said bridge member includes a recess formed therein which is adapted to prevent transverse movement of said pivot pin when said pivot pin is positioned within said recess and said hair barrette is releasably attached to said ornamental pin.

28. An assembly as recited in claim 26 wherein said first aperture is positioned between said bridge member and the first end of said clamping member.

29. An assembly as recited in claim 23 further comprising a bridge member secured to said main body and extending transversely to a longitudinal axis extending through the first and second ends of said hair barrette.

* * * * *